US006931965B1

(12) United States Patent
Fanguy et al.

(10) Patent No.: US 6,931,965 B1
(45) Date of Patent: Aug. 23, 2005

(54) PORTABLE PIPE TONG AND METHOD OF USE

(75) Inventors: Robert P. Fanguy, 3507 Captain Cade Rd., Broussard, LA (US) 70518; David Tilley, Broussard, LA (US)

(73) Assignee: Robert P. Fanguy, Broussard, LA (US)

( * ) Notice: Subject to any disclaimer, the term of this patent is extended or adjusted under 35 U.S.C. 154(b) by 9 days.

(21) Appl. No.: 10/643,505

(22) Filed: Aug. 18, 2003

(51) Int. Cl.[7] ..... B25B 13/50
(52) U.S. Cl. ..... 81/57.36; 81/57.34; 81/57.39
(58) Field of Search ..... 81/55, 57.36, 57.39, 81/180.1, 57.34

(56) References Cited

U.S. PATENT DOCUMENTS 443,312 A 12/1890 Bode
2,492,470 A * 12/1949 Farkas ..... 81/57.39
2,540,553 A 2/1951 Shobe
3,122,952 A 3/1964 Eliason
3,752,016 A 8/1973 Ballard
3,880,024 A 4/1975 Asada
4,305,316 A 12/1981 Lehman
5,062,326 A 11/1991 Goldschmidt
5,546,833 A 8/1996 Holdeman et al.
5,775,183 A * 7/1998 Tavianini ..... 81/57.36
6,634,260 B1 * 10/2003 Smith ..... 81/57.36

* cited by examiner

*Primary Examiner*—James G. Smith
(74) *Attorney, Agent, or Firm*—Robert N. Montgomery

(57) ABSTRACT

A relatively compact portable tong assembly utilizing adaptable jaws for gripping the threaded box and pin ends of adjacent pipe joints without the use of an external support and thus applying final make-up torque or applying initial breakout torque to threaded pipe joints using only a spanner, socket and ratchet or other such hand tools for quickly applying torque to at least one of the tong jaws. An integral means is also provided for accurately measuring the amount of torque being applied to the joints.

16 Claims, 5 Drawing Sheets

PORTABLE PIPE TONG AND METHOD OF USE

1. FIELD OF THE INVENTION

This invention relates generally to pipe tongs apparatus used to make and break pipe joint connections and more particularly to portable, manually operated wrenches using opposable jaws for gripping each pipe comprising a coupled pipe joint and applying torque to at least one of the opposable jaws while retaining the opposite jaw thus exerting a simultaneous multiplied mechanical force on the jaws thereby breaking the coupling apart or applying sufficient torque to seal the joint.

2. GENERAL BACKGROUND

Manually operated pipe wrenches and tongs have been used for many years for applying torque to a threaded pipe joint as is exhibited by U.S. Pat. Nos. 443,312, 2,540,553, 3,122,952, 3,752,016, 3,880,024, 4,305,316, 5,062,326 and 5,546,833. In each of these cases a pipe wrench of some type is secured to each of the coupled pipe members in a manner whereby one of the pipe wrenches may be manipulated to rotate one of the pipe members while the adjacent pipe member is retained. The long torque arms of the pipe wrenches provide a significant mechanical advantage. A threaded member used to exert force on the torque arms in a retracting or extending manner produces and even further advantage.

Looking at the prior art as a whole it becomes obvious that the mechanical pipe coupling tools although effective in most case were simply too large, slow and cumbersome for use in coupling and uncoupling oil field tubular members. It should be noted that there are several disadvantages such as; (i) the need to remove the apparatus from the pipe and reverse the procedure when changing from a make-up to a break-out procedure (ii) the lengthy torque arms, (iii) and the tendency of the pipe wrench jaws to mar the pipe surfaces. Therefore, the process evolved into faster hydraulically driven power tong units. However, recently the older mechanical pipe tongs are being resurrected for specialty operations where it is impractical or impossible to use power tongs as a result of their great bulk and need for a power supply. In such operations there is a need for a relatively fast manual tong unit, that is both compact and portable, is capable of producing a high torque on the pipe coupling without significant marring of the pipe and need not be physically reversed on the pipe when changing between break-out and make-up operations. There is also a need to readily determine the make-up torque applied to each joint.

3. SUMMARY OF THE INVENTION

The present invention teaches the use of a relatively compact portable tong assembly utilizing adaptable jaws for gripping the threaded box and pin ends of adjacent pipe joints without the use of an external support and thus applying final make-up torque or applying initial breakout torque to threaded pipe joints using only a spanner, socket and ratchet or other such hand tools for quickly applying torque to at least one of the tong jaws. An integral means is also provided for accurately measuring the amount of torque being applied to the joints.

4. BRIEF DESCRIPTION OF THF DRAWINGS

For a further understanding of the nature and objects of the present invention, reference should be made to the following detailed description taken in conjunction with the accompanying drawings, in which, like parts are given like reference numerals, and wherein.

5. DETAILED DESCRIPTION OF THE PREFERRED EMBODIMENT

Figure 1:
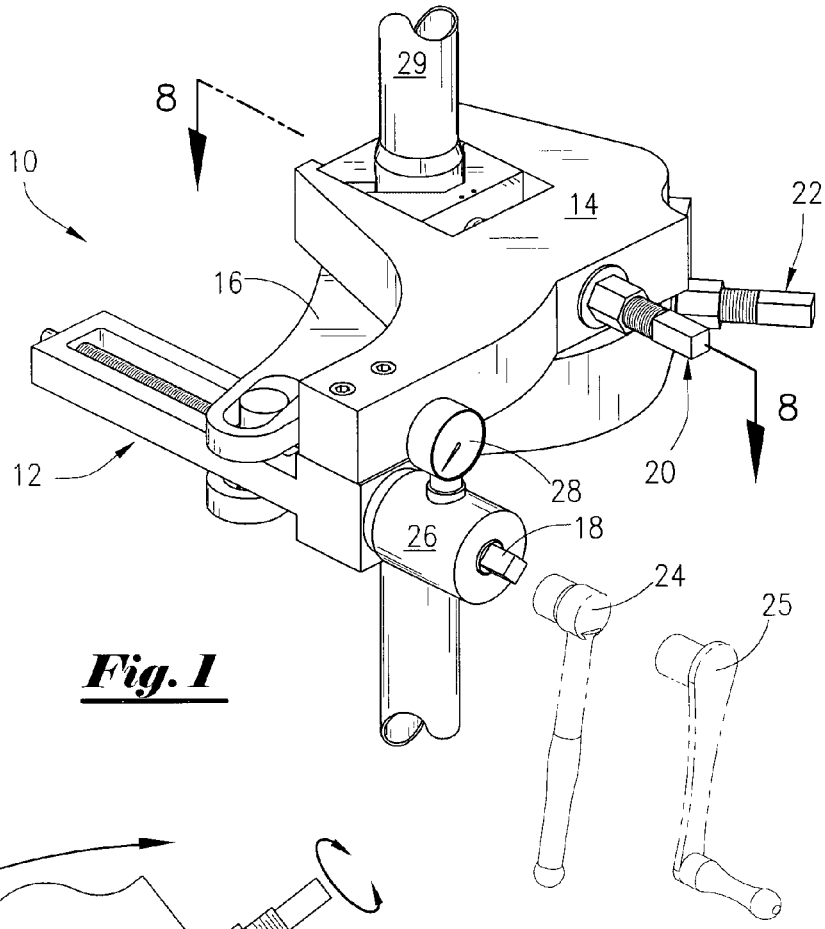
FIG. 1 is an isometric assembly view of the preferred embodiment.

As first seen in FIG. 1 the light weight, portable, manual tong assembly 10 includes a base member including the torque actuator assembly 12 to which is attached an upper tong jaw assembly 14 and a lower pivotal tong jaw assembly 16. Each of the jaw assemblies 14, 16 and the tong torque actuator assembly includes actuator screw assemblies 18, 20, 22, that are rotatable by a wrench which may include a ratchet and socket 24, a spanner 25 or may be operated by a power tool such as an electric or air motor. The torque actuator assembly 12 further includes a load cell assembly 26 and torque pressure gauge 28. The tong assembly 10 is self-supporting by being clamped onto the pipe string 29.

Figure 2:
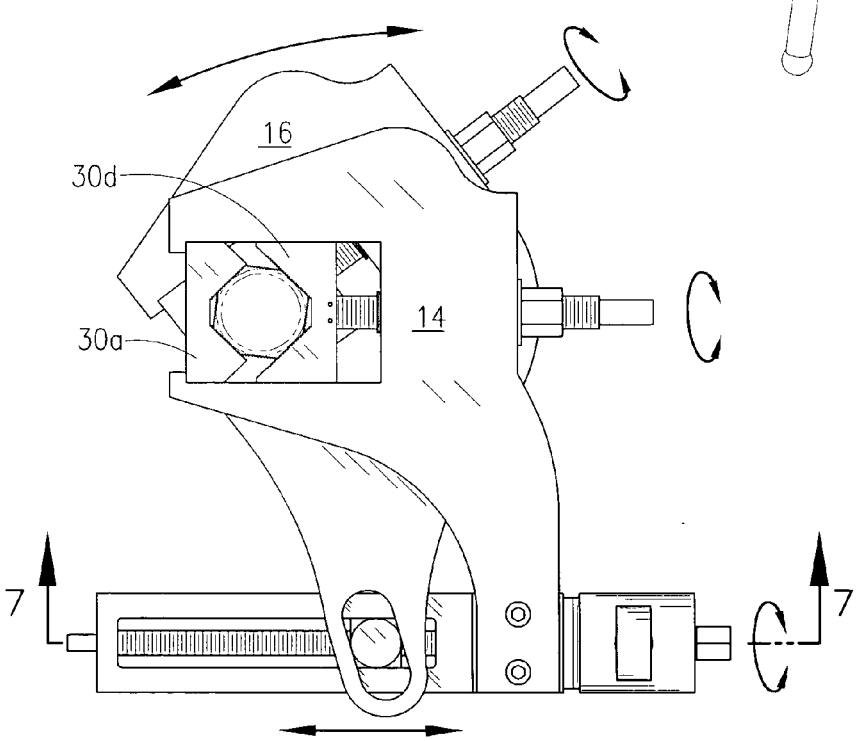
FIG. 2 is a top view of the assembly shown in FIG. 1.
Figure 3:
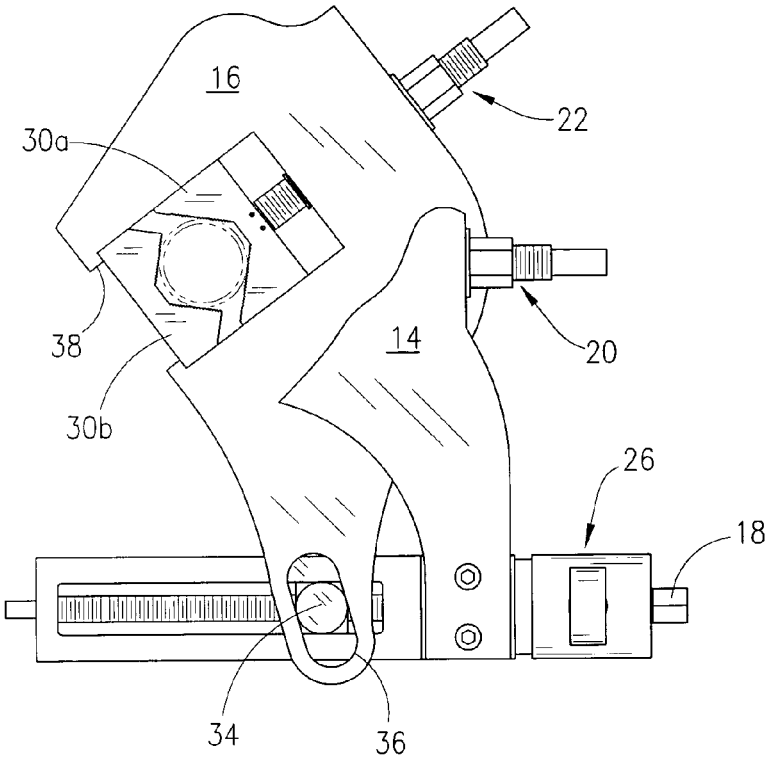
FIG. 3 is a top view of the assembly with the upper jaws partially cut-a-way exposing the lower jaw.
Figure 4:
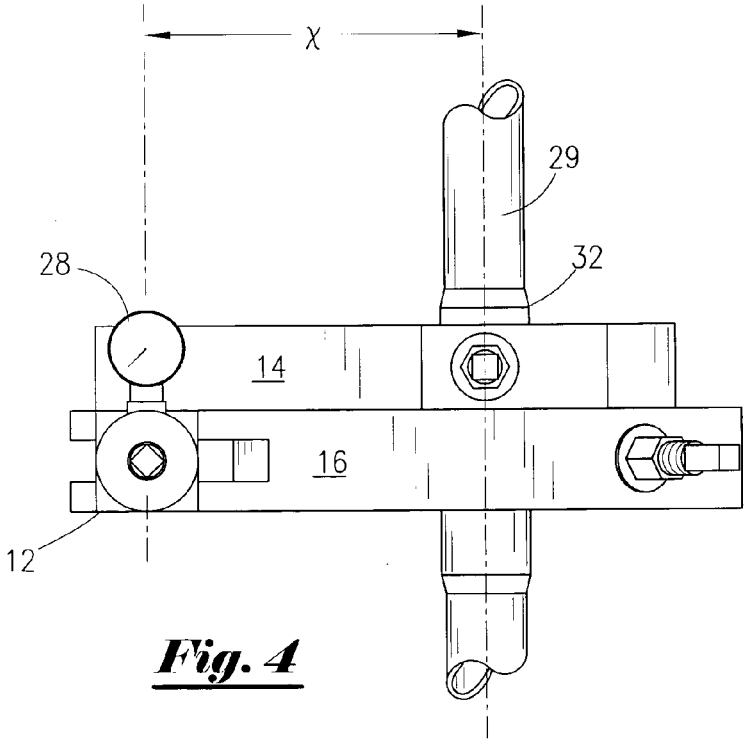
FIG. 4 is a side elevation view of the assembly shown in FIG. 1.

As seen from the top in FIG. 2 the upper tong jaw assembly 14 and lower tong jaw assemblies 16 better seen in cut-a-way FIG. 3 are constructed of light weight materials, both include a pair of opposing pipe dies 30*a*, 30*b* slidable within a channel for engaging the box and pin ends of the coupling 32 better seen in FIG. 4. One of the pipe dies 30*a* retained by the jaws 14 and 16 seen in FIGS. 2 and 3 is rotatably secured to the jack screw assemblies 20, 22, respectively in a manner whereby rotation of there respective screws traverses the jaws 30*a* thereby, engaging the pipe coupling 32. The lower tong jaw 16 seen in FIG. 3 is also transversely pivotal about the threaded lead screw pin 34 via the tong arm slot 36 located in the arm portion of the jaw assembly 16.

The tong assembly 10 is positioned on the pipe coupling as seen in FIG. 4 with each of the jaw assemblies 14 and 16 engaging the adjacent elements of the pipe coupling 32 prior to insertion of the cooperative dies 30*b* retained in position by the ledges 38 located at the mouth of each of the jaw assemblies 14 and 16. Jacking screw assemblies 20 and 22 are then actuated completing the clamping process. Loosing the screws allows the dies 30*b* to be removed from the jaws 14 and 16 and removal from the pipe string 29.

The distance X between the central axis of the pipe coupling 32 and the central axis of the pin assembly 34 seen in FIG. 3 and the thickness of the tong jaws 14,16 may vary depending on the size of the coupling or as the application may require. Torque applied to the pipe coupling 32 by exerting rotary torque on the screw 18 is calculated as a result of known values of distance, thread progression and applied pressure on the load cell assemble 26 and expressed in foot pounds on the torque gauge 28. Other methods of determining applied torque to the pipe joint may simple be a chart correlating applied torque on the load cell to that of calculated torque applied to the joint.

Figure 5:
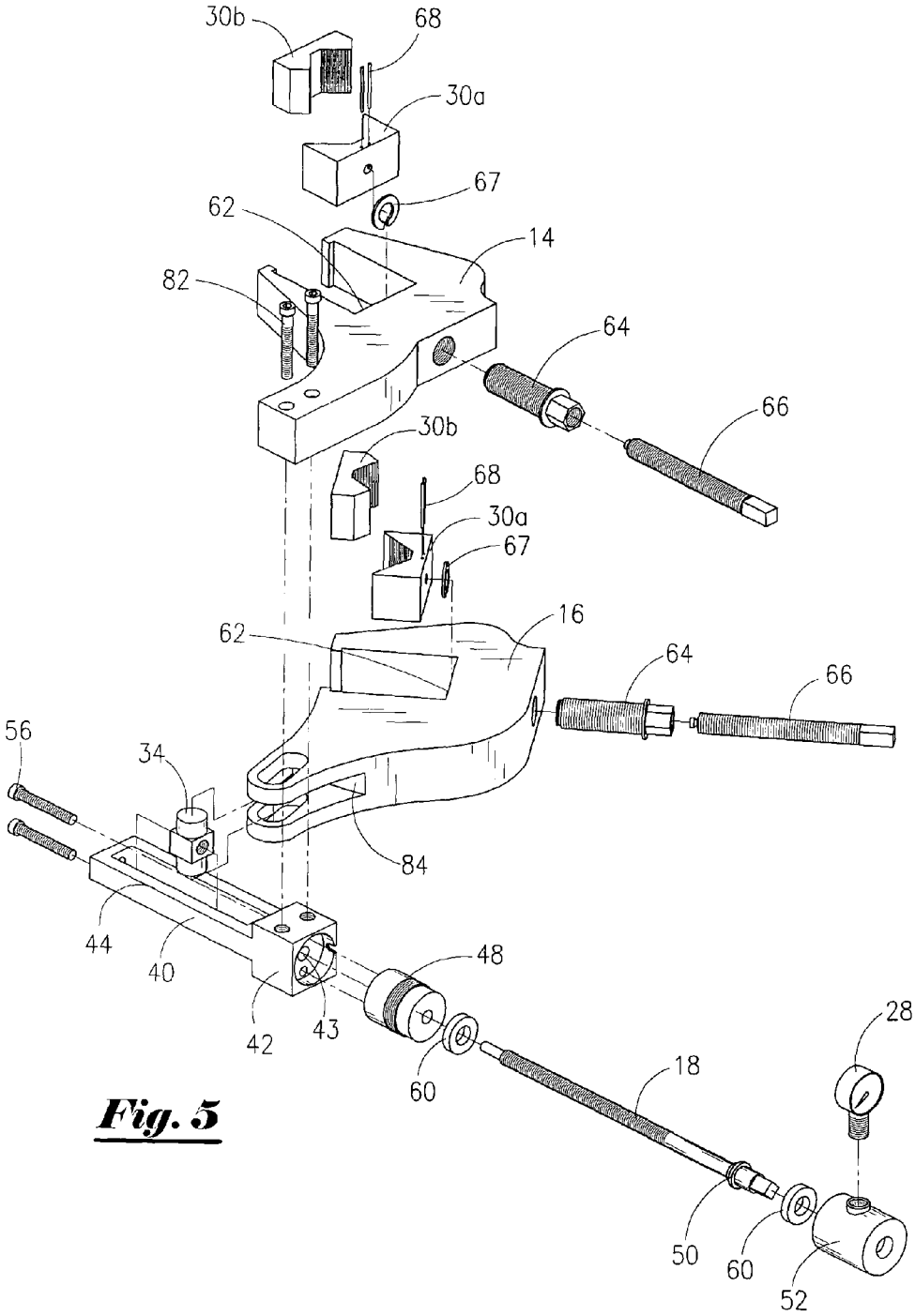
FIG. 5 is an exploded view of the preferred embodiment.

As further seen in FIG. 5 the nomenclature of the afore mentioned portable tong assembly 10 is as follows; an elongated rectangular body member 40 that includes a head portion 42 which includes a longitudinal orifice 43 therein leading to a rectangular tang portion extending from the head portion and includes an elongated slotted portion 44 for slidable receiving a pin member 34. The head portion further including both longitudinal apertures and transverse threaded holes for receiving threaded members 56 and 82 and is counter bored for receiving the load cell 48. A lead screw 18 fitted with thrust bearings 60 located on each side of a shoulder 50 and threadably engaging the pin 34. A housing 52 threadably attached to the load cell 48 retains the lead screw and bearings 60 in position relative to the body member 40. The housing 52 further provides mounting and access to the load cell 48 for gauge member 28.

Each of the jaw assemblies 14 and 16 include jack screw assemblies 20 and 22 that further include removable threaded sleeves 64, screw member 66, washer 67 and retainer pins 68. It should be noted that the lower or pivotal tong jaw 16 includes an arm portion having a transverse channel 84 with each side of the channel having elongated slots 36 for straddling the tang portion of the base member 40 and capturing pin 34 being slidable within the slots 44 and 36.

Figure 6:
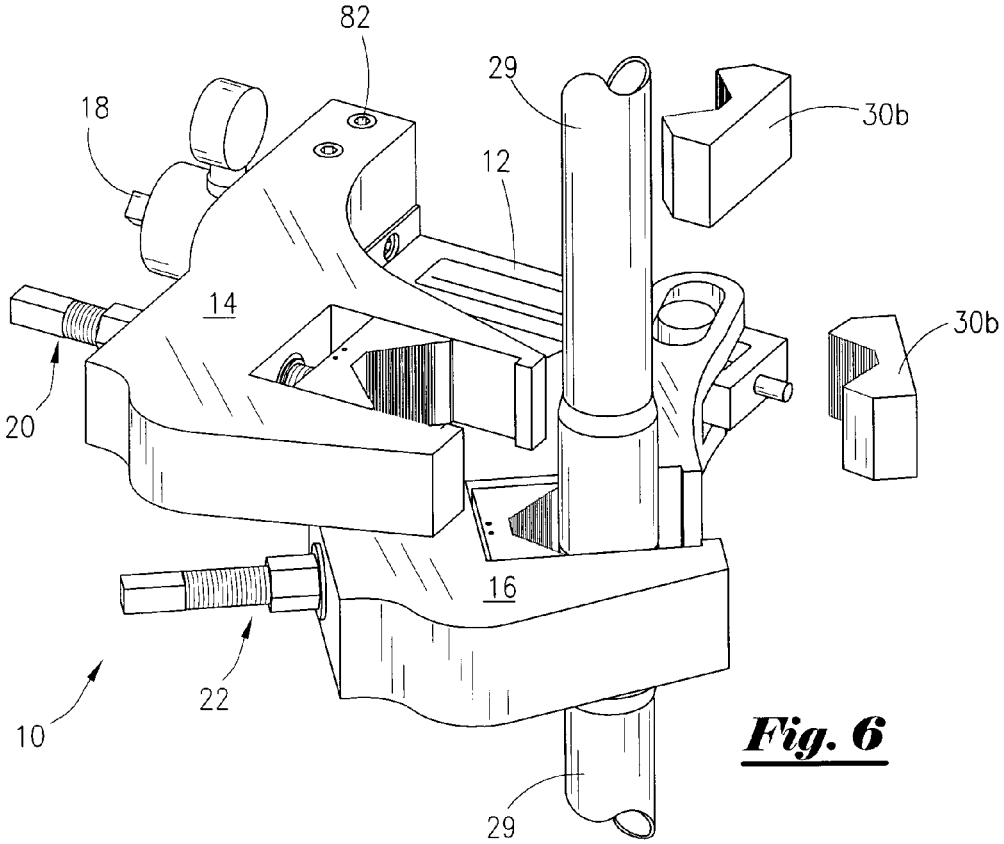
FIG. 6 is a partial exploded view of the assembly engaging a pipe coupling.

As further depicted in FIG. 6 the dies 30*b* are readily slidably inserted or removed. By first installing a die 30*b* into the cavity 62 the jaw 16 and rotating the screw assembly 22 thus securing the tong to the pipe string 29, rotating the lead screw assembly 18 then rotates the base member 12 about the axis of the pipe string thereby allowing the upper jaw to engage the pipe string 29. Inserting the remaining die 30*b* and tightening the upper jaw 14-screw assembly 20 completes the attachment procedure. Further tightening of the lead screw 18 applies torque to the lower jaw assembly 16 while retaining the upper jaw assembly 14, thereby coupling or uncoupling the pipe joint.

Figure 7:
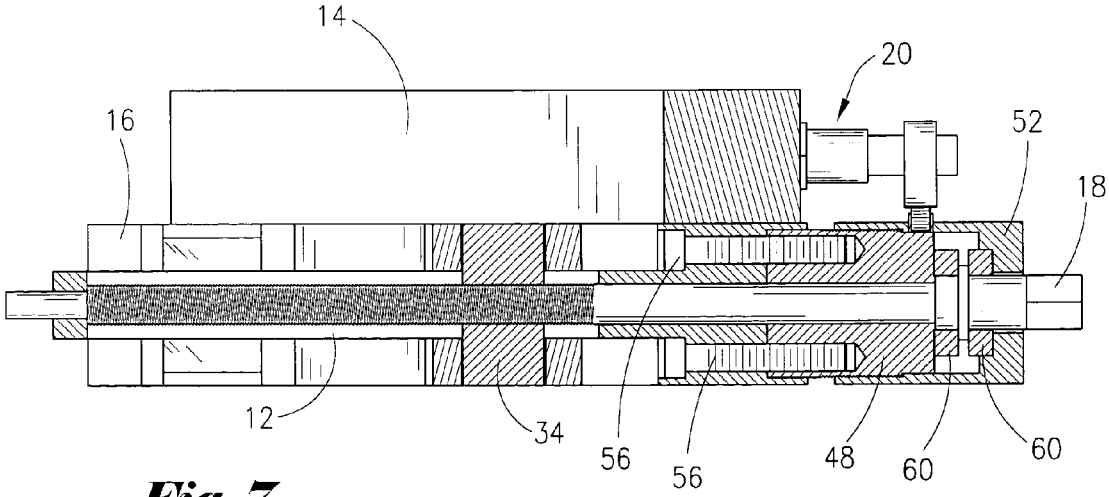
FIG. 7 is a vertical cross section view of the tong assembly.

The lead screw assembly and load cell assembly is further detailed in cross-section in FIG. 7. Here we see that the lead screw 18 is supported at the head end by thrust bearing 60 located within the housing 52 and threadably attached to the pin member 34 that is slidable within the slot 44 better seen in FIG. 8 and further supported at the opposite end of the base member 40 by a bushing. Rotation of the lead screw brings one of the thrust bearings 60 into contact with the load cell 48 thereby applying pressure to the cell as an indication of the applied torque as read on the gauge 28 seen in previous figures.

Figure 8:
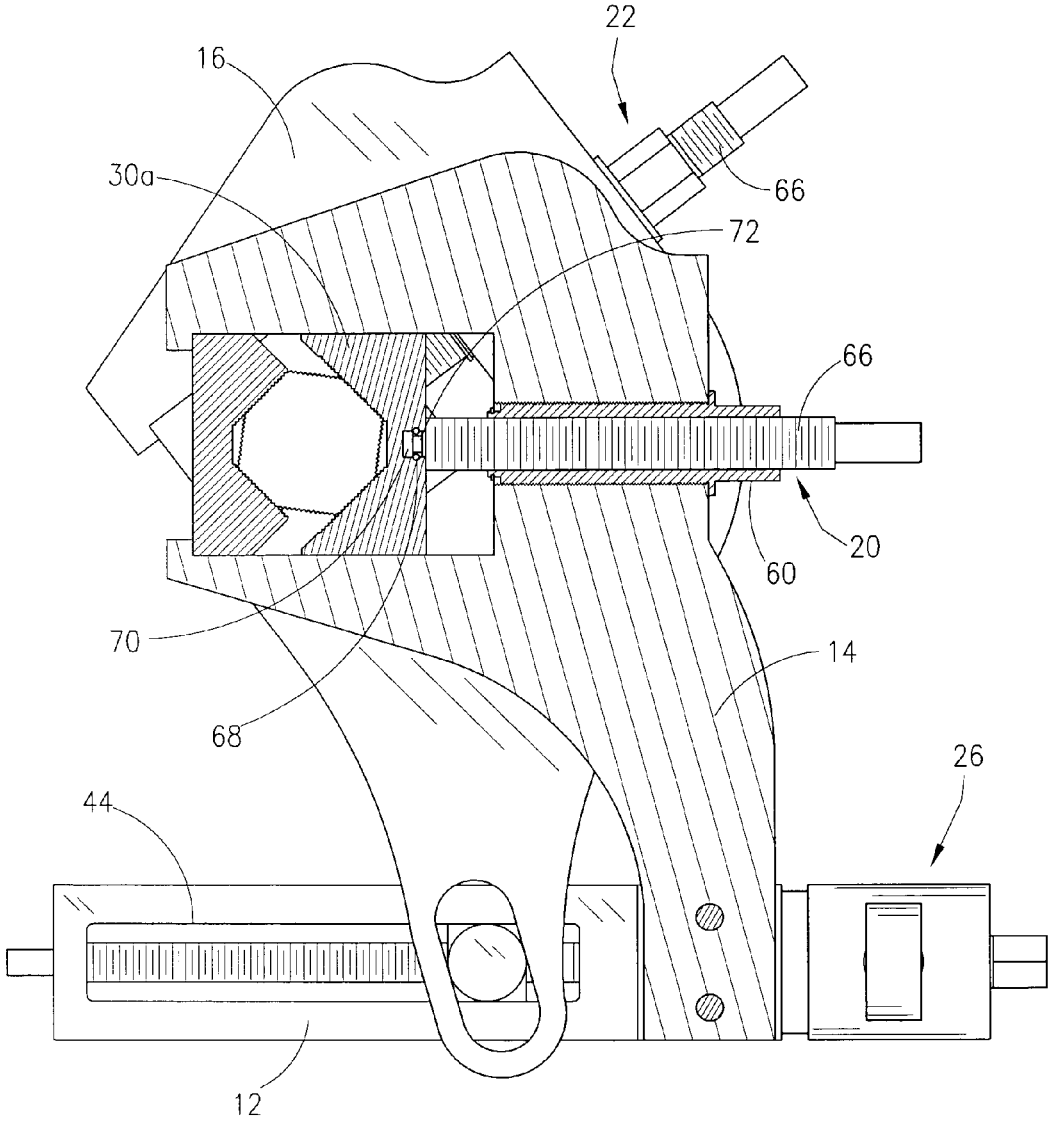
FIG. 8 is a partial cross section view of the stationary jaw assembly.

As best seen in FIG. 8 the screw assemblies utilize a threaded sleeve 60 removably threaded into the jaws 14 and 16 and the screw members 66 are threaded into the threaded sleeve 60. A nipple 70 is provided at one end of the screw member 66 with a radial groove 72 therein for insertion into a corresponding hole in the dies 30*a*. Retainer pins 68 inserted into the die 30*a* intersecting the radial groove on the nipple 70 retain the die to the screw member 66 while still allowing rotation of the screw member 66 relative to the die 30*a*.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A manually operated tong assembly comprising:

a) an elongated, rectangular body member having an elongated slot portion and an elongated lead screw member extending through said slot portion and at least the length of said body member;

b) an upper tong jaw fixed to said body member having sliding pipe dies captured therein and means for positioning at least one of said dies relative to said upper tong jaw; and c) a lower tong jaw having sliding pipe dies captured therein, means for positioning at least one of said dies relative to said lower tong jaw, and a slotted arm portion pivotally and translatively attached to a pin assembly threadably traversable along said elongated lead screw member located within said elongated slot portion of said body member.

2. The manually operated tong assembly according to claim 1 wherein said tong assembly further comprises a load cell activated by rotation of said lead screw.

3. The manually operated tong assembly according to claim 1 wherein said means for positioning at least one of said pipe dies is a jack screw rotatably connected to at least one of said pipe dies.

4. The manually operated tong assembly according to claim 3 wherein said jackscrew is threadably engaged with an externally threaded sleeve member.

5. The manually operated tong assembly according to claim 1 wherein one of said pipe dies located within in each said tong jaw is slidably removable.

6. The manually operated tong assembly according to claim 1 wherein said slotted arm portion is defined by a transverse channel each side of said channel having opposing parallel elongated slots therein.

7. The manually operated tong assembly according to claim 6 wherein a portion of said pin assembly is captured within each of said elongated slots located in said lower tong jaw.

8. The manually operated tong assembly according to claim 2 wherein said lead screw further comprises a thrust bearing attached thereto for making compressive contact with said load cell.

9. The manually operated tong assembly according to claim 8 wherein load cell further comprises a gauge for registering compressive force applied to said load cell by said lead screw.

10. A lightweight, manually operated pipe tong assembly clampable to pipe string comprising:

a) an elongated body member having a head portion and a tang portion having an elongated slot, said head portion having a central longitudinal counter bore and a central longitudinal orifice within said counter bore communicative with said elongated slot, said tang portion having a central longitudinal orifice located opposite said head portion;

b) a lead screw member rotatably extending longitudinally through said central longitudinal orifice and said central longitudinal orifice located within said tang portion opposite said head portion;

c) a pin member threadably located upon said lead screw member slidable within said elongated slot, a portion of said pin member extending above and below said tang portion;

d) a first jaw member removably attached to said head portion of said elongated body member; and e) a second jaw member having an arm portion comprising a transverse channel, each side of said channel having opposing elongated slots, said slots being capable of capturing said portion of said pin member extending above and below said tang portion in a pivotal manner.

11. The lightweight, manually operated pipe tong assembly according to claim 10 wherein each said jaw member further comprises a set of pipe dies slidable within a channel.

12. The lightweight, manually operated pipe tong assembly according to claim 11 wherein at least one of said pipe dies is rotatably attached to a jack screw extending from said tong jaw.

13. The lightweight, manually operated pipe tong assembly according to claim 12 wherein said jack screw is threadably interposed within an externally threaded sleeve threadably installed within said tong jaw.

14. The lightweight, manually operated pipe tong assembly according to claim 12 wherein said jackscrew comprises means for rotatable connection to at least one of said dies.

15. The lightweight, manually operated pipe tong assembly according to claim 10 wherein said tong assembly further comprises a load cell attached to said head portion and a housing threadably attached to said load cell extending over a portion of said lead screw in a manner whereby a portion of said lead screw extends beyond said housing.

16. The lightweight, manually operated pipe tong assembly according to claim 15 wherein said pipe tong assembly further comprises a gauge connected to said load cell.

* * * * *